US010336096B2

(12) United States Patent
Ito et al.

(10) Patent No.: US 10,336,096 B2
(45) Date of Patent: Jul. 2, 2019

(54) PRINTING APPARATUS, CONTROL METHOD OF PRINTING APPARATUS, AND NON-TRANSITORY COMPUTER READABLE RECORDING MEDIUM

(71) Applicant: CASIO COMPUTER CO., LTD., Shibuya-ku, Tokyo (JP)

(72) Inventors: Masaki Ito, Ome (JP); Takeo Ozawa, Akishima (JP); Naoki Ogawa, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 31 days.

(21) Appl. No.: 15/677,608

(22) Filed: Aug. 15, 2017

(65) Prior Publication Data

US 2018/0086102 A1 Mar. 29, 2018

(30) Foreign Application Priority Data

Sep. 23, 2016 (JP) ..... 2016-185265

(51) Int. Cl.
*B41J 2/355* (2006.01)
*B41J 2/32* (2006.01)

(52) U.S. Cl.
CPC ..... *B41J 2/3558* (2013.01); *B41J 2/32* (2013.01)

(58) Field of Classification Search
CPC ..... B41J 2/32; B41J 2/35; B41J 2/355; B41J 2/3551; B41J 2/3553; B41J 2/3555; B41J 2/3558
See application file for complete search history.

(56) References Cited

U.S. PATENT DOCUMENTS

2015/0183230 A1* 7/2015 Horiuchi ..... B41J 2/355 347/211

FOREIGN PATENT DOCUMENTS

JP 2013052539 A 3/2013

* cited by examiner

*Primary Examiner* — Kristal Feggins
(74) *Attorney, Agent, or Firm* — Holtz, Holtz & Volek PC

(57) ABSTRACT

Provided is a printing apparatus which includes a thermal head having a plurality of heat generation elements whose temperatures are controlled by applying a voltage and performing printing on a printing medium and a head drive circuit being supplied periodically with a control signal and print data to control application of a voltage to each of the plurality of heat generation elements. One period of the control signal includes first and second voltage application control periods which are separated from each other. The first voltage application control period is a period in which the printing is performed by controlling the application of a voltage, and the second voltage application control period is a period in which the printing is not performed and a temperature of the thermal head is adjusted by controlling the application of a voltage.

11 Claims, 7 Drawing Sheets

PRINTING APPARATUS, CONTROL METHOD OF PRINTING APPARATUS, AND NON-TRANSITORY COMPUTER READABLE RECORDING MEDIUM

CROSS-REFERENCE TO RELATED APPLICATIONS

The corresponding Japanese application

Application number: 2016-185265, filing date: Sep. 23, 2016

BACKGROUND OF THE INVENTION

1. Field of the Invention

The present invention relates to a printing apparatus, a control method of a printing apparatus, and a non-transitory computer-readable recording medium.

2. Description of the Related Art

In the related art, there is known a printing apparatus that performs printing by transferring ink applied to an ink ribbon to a printing medium by controlling application of a voltage to a heat generation element provided in a thermal head.

In such a printing apparatus employing a thermal transfer system, sometimes, a phenomenon called sticking may occur in which an ink ribbon sticks to a thermal head when a rapid change in temperature from a high temperature to a low temperature occurs in the thermal head. If the sticking occurs, printing is not normally performed, and an area where printing is not performed partially occurs, so that printing quality significantly is deteriorated.

JP 2013-052539 A discloses a thermal printer which prevents occurrence of sticking by chopper control. The chopper control is a technique where application of a voltage/non-application of a voltage to a thermal head is frequently switched, and by performing the chopper control, it is possible to prevent a rapid change in temperature of the thermal head.

However, a circuit for the chopper control is added to the printing apparatus, and thus, it is not preferable that the addition of the circuit leads to an increase in cost in product manufacturing. On the other hand, when the chopper control is realized by software, it is inevitable that a control program becomes complicated and large scale.

For this reason, in a printing apparatus, control capable of suppressing occurrence of sticking and being simpler than the chopper control is desired.

BRIEF SUMMARY OF THE INVENTION

According to the one embodiment, it is possible to suppress occurrence of sticking by a simple control in a printing apparatus which performs printing on a printing medium with a thermal head.

In order to obtain the above advantages, there is provided a printing apparatus including:

a thermal head that performs printing on a printing medium; and a head drive circuit that drives the thermal head, wherein the thermal head has a plurality of heat generation elements whose temperatures are controlled by applying a voltage, the head drive circuit controls application of a voltage to each of the plurality of heat generation elements according to drive data periodically supplied, the drive data including a control signal and print data, one period of the control signal includes a first voltage application control period and a second voltage application control period which are separated from each other, the first voltage application control period is a period in which the printing is performed by controlling the application of a voltage, and the second voltage application control period is a period in which the printing is not performed and a temperature of the thermal head is adjusted by controlling the application of a voltage.

In order to obtain the above advantages, there is provided a control method of a printing apparatus, the printing apparatus including a thermal head that performs printing on a printing medium and a head drive circuit that drives the thermal head, wherein the thermal head has a plurality of heat generation elements whose temperatures are controlled by applying a voltage, and the head drive circuit controls application of a voltage to each of the plurality of heat generation elements according to drive data periodically supplied, the drive data including a control signal and print data, the control method including the steps of:

setting one period of the control signal so as to include a first voltage application control period and a second voltage application control period which are separated from each other, the first voltage application control period being a period in which the printing is performed by controlling the application of a voltage and the second voltage application control period being a period in which the printing is not performed and a temperature of the thermal head is adjusted by controlling the application of a voltage; and supplying the control signal and the print data to the head drive circuit to drive the thermal head by the head drive circuit.

In order to obtain the above advantages, there is provided a non-transitory computer-readable recording medium on which a control program of a printing apparatus is recorded, wherein the printing apparatus includes a thermal head that performs printing on a printing medium and a head drive circuit that drives the thermal head, the thermal head has a plurality of heat generation elements whose temperatures are controlled by applying a voltage, and the head drive circuit controls application of a voltage to each of the plurality of heat generation elements according to drive data periodically supplied, the drive data including a control signal and print data, and the control program causes a computer to:

set one period of the control signal so as to include a first voltage application control period and a second voltage application control period which are separated from each other, the first voltage application control period being a period in which the printing is performed by controlling the application of a voltage and the second voltage application control period being a period in which the printing is not performed and a temperature of the thermal head is adjusted by controlling the application of a voltage; and supply the control signal and the print data to the head drive circuit to drive the thermal head by the head drive circuit.

DETAILED DESCRIPTION OF THE INVENTION

Hereinafter, embodiments of a printing apparatus and a printing control method according to the present invention will be described in detail with reference to the drawings.

Figure 1:
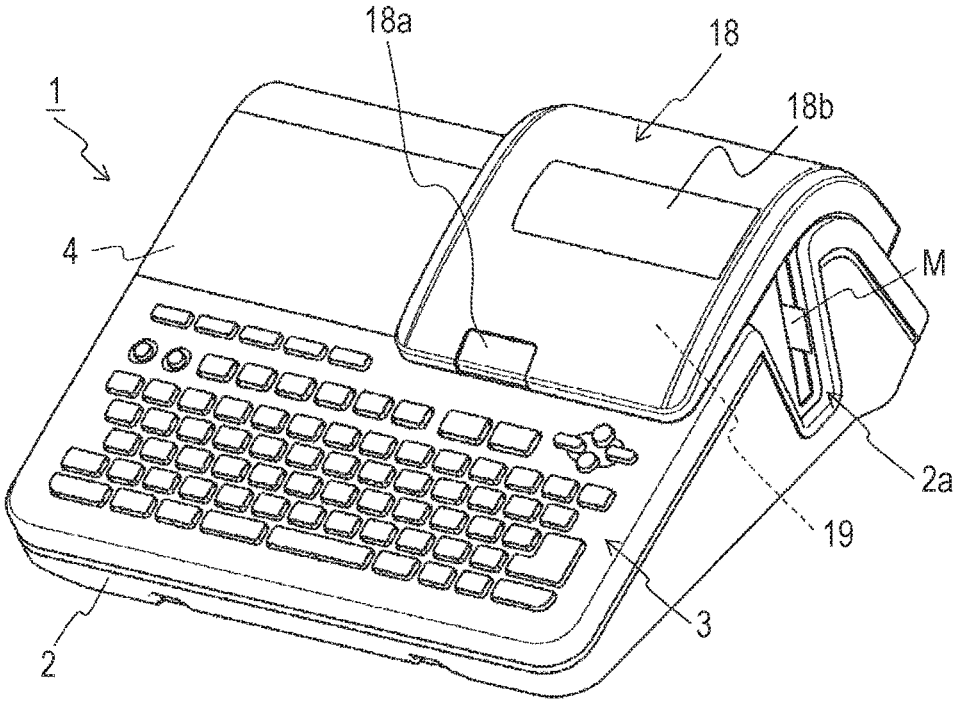
FIG. 1 is a perspective view illustrating a printing apparatus.

FIG. 1 is a perspective view illustrating a printing apparatus 1 according to one embodiment of the present invention.

The printing apparatus 1 is a printing apparatus including a thermal head that performs printing on a printing medium and is, for example, a label printer that performs printing in a single pass scheme on an elongated printing medium M.

Hereinafter, a thermal transfer type label printer using an ink ribbon will be described as an example. However, the printing type is not particularly limited. The printing type may be any type as long as sticking can occur, and for example, a thermal type using thermal paper may be used.

The printing medium M is, for example, a tape member having a base material having an adhesive layer and a release sheet stickably attached to the base material so as to cover the adhesive layer.

In addition, the printing medium M may be a tape member without a release sheet.

As illustrated in FIG. 1, the printing apparatus 1 is configured to include an apparatus casing 2, an input device 3, a display device 4, an opening/closing cover 18, and a cassette accommodating portion 19.

The input device 3, the display device 4, and the opening/closing cover 18 are arranged on an upper surface of the apparatus casing 2.

Although not illustrated, the apparatus casing 2 is provided with a power cord connection terminal, an external device connection terminal, a storage medium insertion port, and the like.

The input device 3 includes various keys such as an input key, a cross key, a conversion key, an enter key, and the like.

The display device 4 is, for example, a liquid crystal display panel and displays, for example, characters corresponding to inputs from the input device 3, selection menus for various settings, messages relating to various processes, and the like.

On the display device 4, during printing, contents (hereinafter, referred to as printing contents) of letters or figures, or the like instructed to print on the printing medium M may be displayed, and the progress status of the printing process may be displayed.

In addition, the display device 4 may be provided with a touch panel unit, and in this case, the display device 4 may be regarded as a portion of the input device 3.

The opening/closing cover 18 is arranged on an upper portion of the cassette accommodating portion 19 so as to be openable and closable.

The opening/closing cover 18 is opened by pressing a button 18*a*.

In order to visually recognize whether or not a tape cassette 30 (refer to FIG. 2) is accommodated in the cassette accommodating portion 19 even in the state where the opening/closing cover 18 is closed, a window 18*b* is formed in the opening/closing cover 18.

A discharge port 2*a* is formed on a side surface of the apparatus casing 2. The printing medium M on which printing has been performed in the printing apparatus 1 is discharged from the discharge port 2*a* to the outside of the apparatus.

Figure 2:
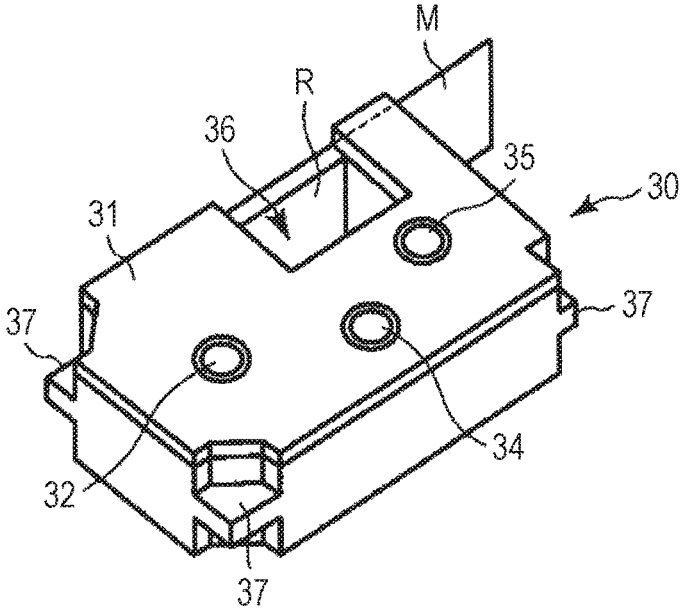
FIG. 2 is a perspective view illustrating a tape cassette accommodated in a printing apparatus.

FIG. 2 is a perspective view illustrating the tape cassette 30 accommodated in the printing apparatus 1.

Figure 3:
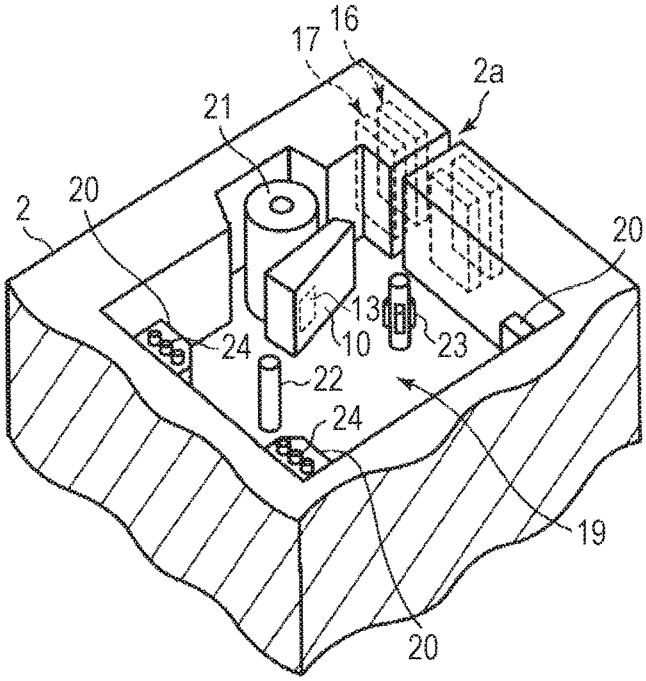
FIG. 3 is a perspective view illustrating a cassette accommodating portion of the printing apparatus.

FIG. 3 is a perspective view illustrating the cassette accommodating portion 19 of the printing apparatus 1.

Figure 4:
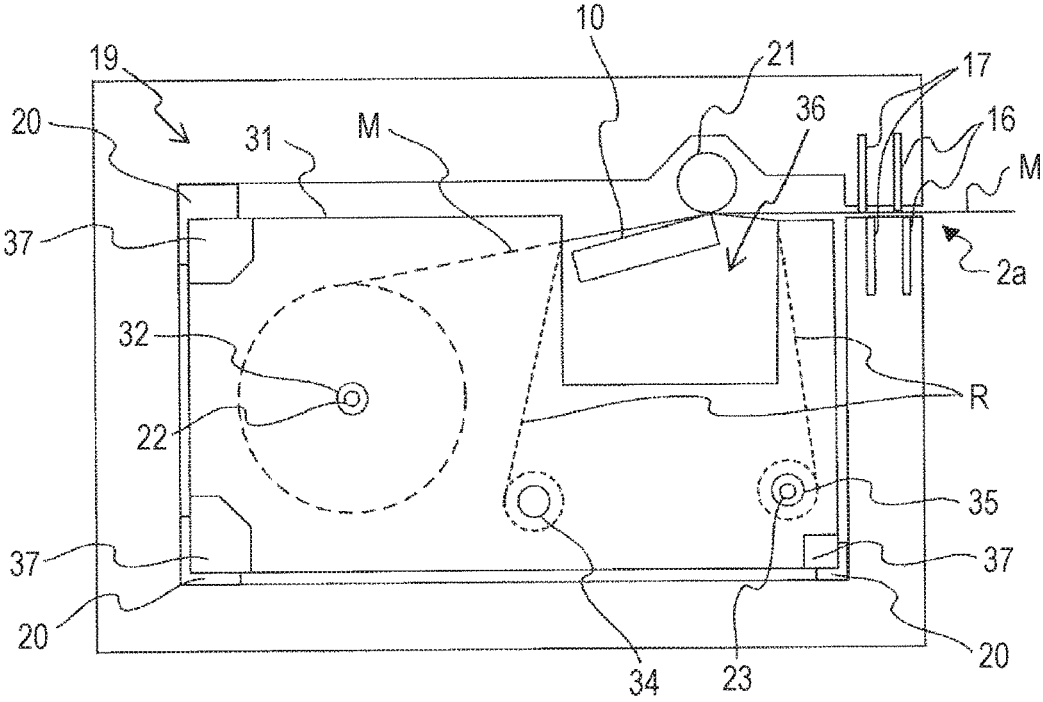
FIG. 4 is a cross-sectional view illustrating the printing apparatus.

FIG. 4 is a cross-sectional view illustrating the printing apparatus 1.

The tape cassette 30 illustrated in FIG. 2 is detachably accommodated in the cassette accommodating portion 19 illustrated in FIG. 3.

FIG. 4 illustrates a state where the tape cassette 30 is accommodated in the cassette accommodating portion 19.

As illustrated in FIG. 2, the tape cassette 30 is configured to include a cassette case 31 in which a thermal head inserted portion 36 and engaging portions 37 are formed, and accommodates the printing medium M and the ink ribbon R. A tape core 32, an ink ribbon supply core 34, and an ink ribbon winding core 35 are provided in the cassette case 31.

The printing medium M is wound in a roll shape on the tape core 32 inside the cassette case 31.

The ink ribbon R for thermal transfer is wound like a roll around the ink ribbon supply core 34 inside the cassette case 31 in a state where the distal end thereof is wound around the ink ribbon winding core 35.

As illustrated in FIG. 3, a plurality of cassette receiving portions 20 for supporting the tape cassette 30 at predefined positions are provided in the cassette accommodating portion 19 of the apparatus casing 2.

The cassette receiving portion 20 is provided with a tape width detection switch 24 for detecting the width of the tape (printing medium M) accommodated by the tape cassette 30.

The tape width detection switch 24 is a detection device that detects the width of the printing medium M on the basis of the shape of the cassette.

The cassette accommodating portion 19 is further provided with a thermal head 10 having a plurality of heat generation elements for performing printing on the printing medium M, a platen roller 21 serving as a conveying mechanism for conveying the printing medium M, and a tape core engagement shaft 22, and an ink ribbon winding drive shaft 23.

A thermistor 13 is buried in the thermal head 10. The thermistor 13 is a measuring device for measuring a temperature of the thermal head 10.

In the state where the tape cassette 30 is accommodated in the cassette accommodating portion 19, as illustrated in FIG. 4, the engaging portions 37 provided in the cassette case 31 are supported by the cassette receiving portions 20 provided in the cassette accommodating portion 19, and the thermal head 10 is inserted into the thermal head inserted portion 36 formed in the cassette case 31.

The tape core 32 of the tape cassette 30 is engaged with the tape core engagement shaft 22, and the ink ribbon winding core 35 is engaged with the ink ribbon winding drive shaft 23.

If a print instruction is input to the printing apparatus 1, the printing medium M is fed out from the tape core 32 by the rotation of the platen roller 21. At this time, as the ink ribbon winding drive shaft 23 rotates synchronously with the platen roller 21, the ink ribbon R is fed out from the ink ribbon supply core 34 together with the printing medium M. As a result, the printing medium M and the ink ribbon R are conveyed in the state of being overlapped.

Then, when passing between the thermal head 10 and the platen roller 21, the ink ribbon R is heated by the thermal head 10, so that printing is performed by transferring the ink to the printing medium M.

The used ink ribbon R that has passed through between the thermal head 10 and the platen roller 21 is wound on the ink ribbon winding core 35.

On the other hand, the printed printing medium M that has passed through between the thermal head 10 and the platen roller 21 is cut by a half-cutting mechanism 16 and a full-cutting mechanism 17 and discharged from the discharge port 2*a*.

Figure 5:
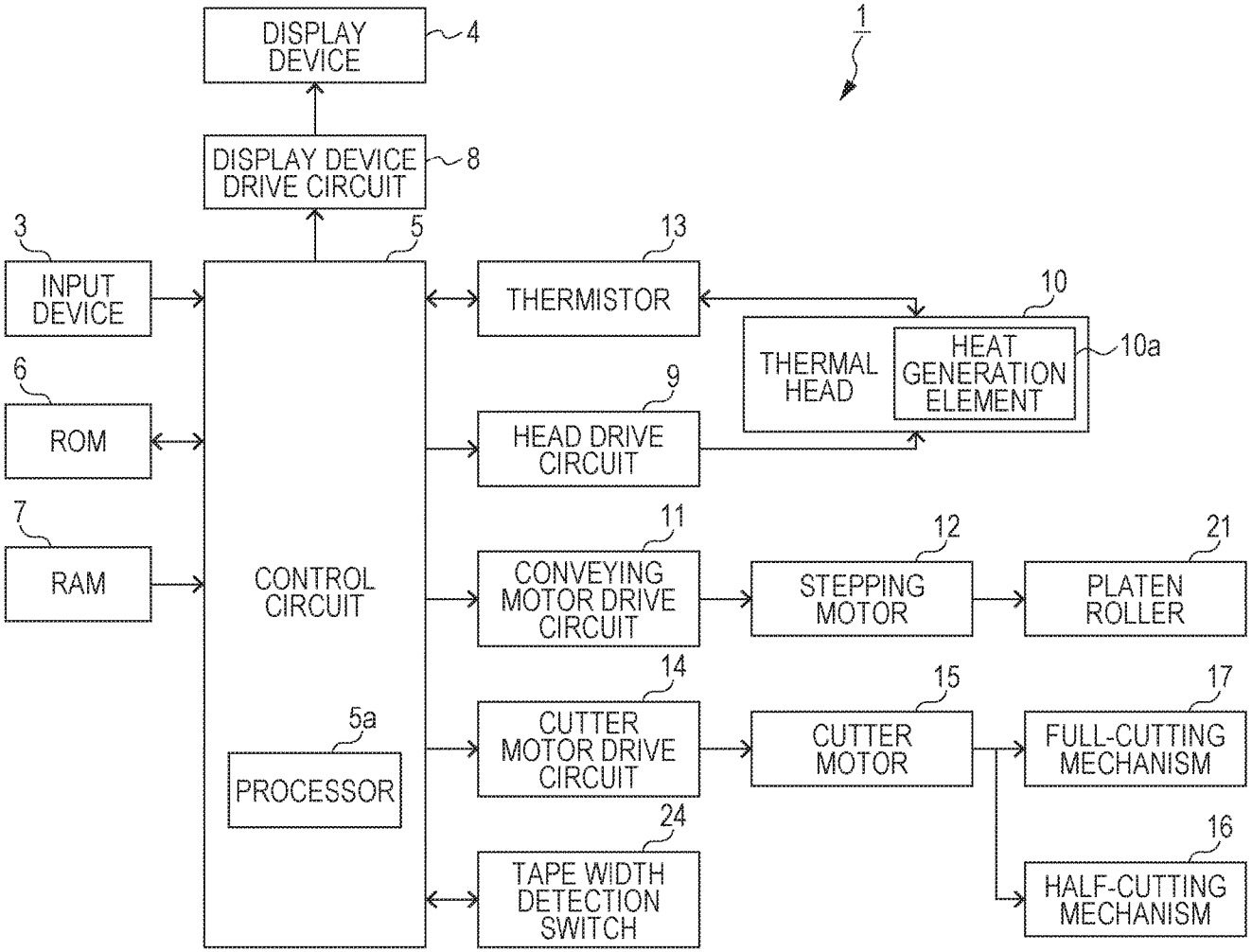
FIG. 5 is a control block diagram illustrating the printing apparatus.

FIG. 5 is a control block diagram illustrating the printing apparatus 1.

In addition to the input device 3, the display device 4, the thermal head 10, the thermistor 13, the half-cutting mechanism 16, the full-cutting mechanism 17, the platen roller 21, the tape width detection switch 24, the printing apparatus 1 is configured to include a control circuit (processor) 5, a read only memory (ROM) 6, a random access memory (RAM) 7, a display device drive circuit 8, a head drive circuit 9, a conveying motor drive circuit 11, a stepping motor 12, a cutter motor drive circuit 14, and a cutter motor 15.

The control circuit 5, the ROM 6, and the RAM 7 constitute a computer of the printing apparatus 1.

The control circuit (processor) 5 is configured to include a processor 5*a* such as a central processing unit (CPU).

The control circuit 5 controls operations of each component of the printing apparatus 1 by developing a program stored in the ROM 6 on the RAM 7 and executing the program.

The control circuit 5 is, for example, a head control circuit that controls the thermal head 10 through the head drive circuit 9, and the control circuit generates a strobe signal and print data and supplies the strobe signal and the print data to the head drive circuit 9.

The control circuit 5 is a conveying control circuit for controlling the platen roller 21 and is a cut control circuit for controlling the cut mechanisms.

The ROM 6 stores a print program for performing printing on the printing medium M and various data (for example, fonts or the like) necessary for executing the print program. The ROM 6 also functions as a storage medium in which a program readable by the control circuit 5 is stored.

The RAM 7 functions as an input data memory that stores information (hereinafter, referred to as printing information) about printing.

The RAM 7 also functions as a print data memory for storing data (hereinafter, referred to as print data) indicating the pattern of the print content to be formed on the printing medium, which is generated on the basis of the print information.

Furthermore, the RAM 7 also functions as a display data memory for storing display data generated on the basis of the print information.

The display device drive circuit 8 controls the display device 4 on the basis of the display data stored in the RAM 7.

Under the control of the display device drive circuit 8, for example, the display device 4 may display the print contents in such a manner that the progress status of the print process can be recognized.

The head drive circuit 9 drives the thermal head 10 according to the strobe signal which is a control signal and the print data supplied from the control circuit 5. The control signal and the print data are drive data, and the drive data is periodically supplied to the head drive circuit 9.

More specifically, during a period (hereinafter, referred to as a voltage application control period) when the strobe signal (control signal) is ON, application of a voltage or non-application of a voltage to the plurality of heat generation elements 10*a* is performed on the basis of the print data.

The thermal head 10 is a print head having a plurality of the heat generation elements 10*a* arranged in a main scanning direction.

In the thermal head 10, the head drive circuit 9 selectively performs application of a voltage to the heat generation element 10*a* according to the print data during the voltage application control period of the strobe signal supplied from the control circuit 5, so that, by allowing the heat generation element 10*a* to generate heat to heat the ink ribbon R and sequentially performing printing line by line (printing line) on the printing medium M by the thermal transfer, printing of a figure according to the print data by a desired plurality of lines is performed.

The conveying motor drive circuit 11 drives the stepping motor 12.

The stepping motor 12 drives the platen roller 21.

The platen roller 21 is a conveying mechanism that rotates by the power of the stepping motor 12 and conveys the printing medium M in a longitudinal direction (sub scanning direction) of the printing medium M.

The cutter motor drive circuit 14 drives the cutter motor 15.

The half-cutting mechanism 16 and the full-cutting mechanism 17 are operated by the power of the cutter motor 15 to perform half-cutting or full-cutting of the printing medium M.

The full cutting is an operation of cutting the base material of the printing medium M along the width direction together with the release sheet, and the half cutting is an operation of cutting only the base material along the width direction.

Figure 6:
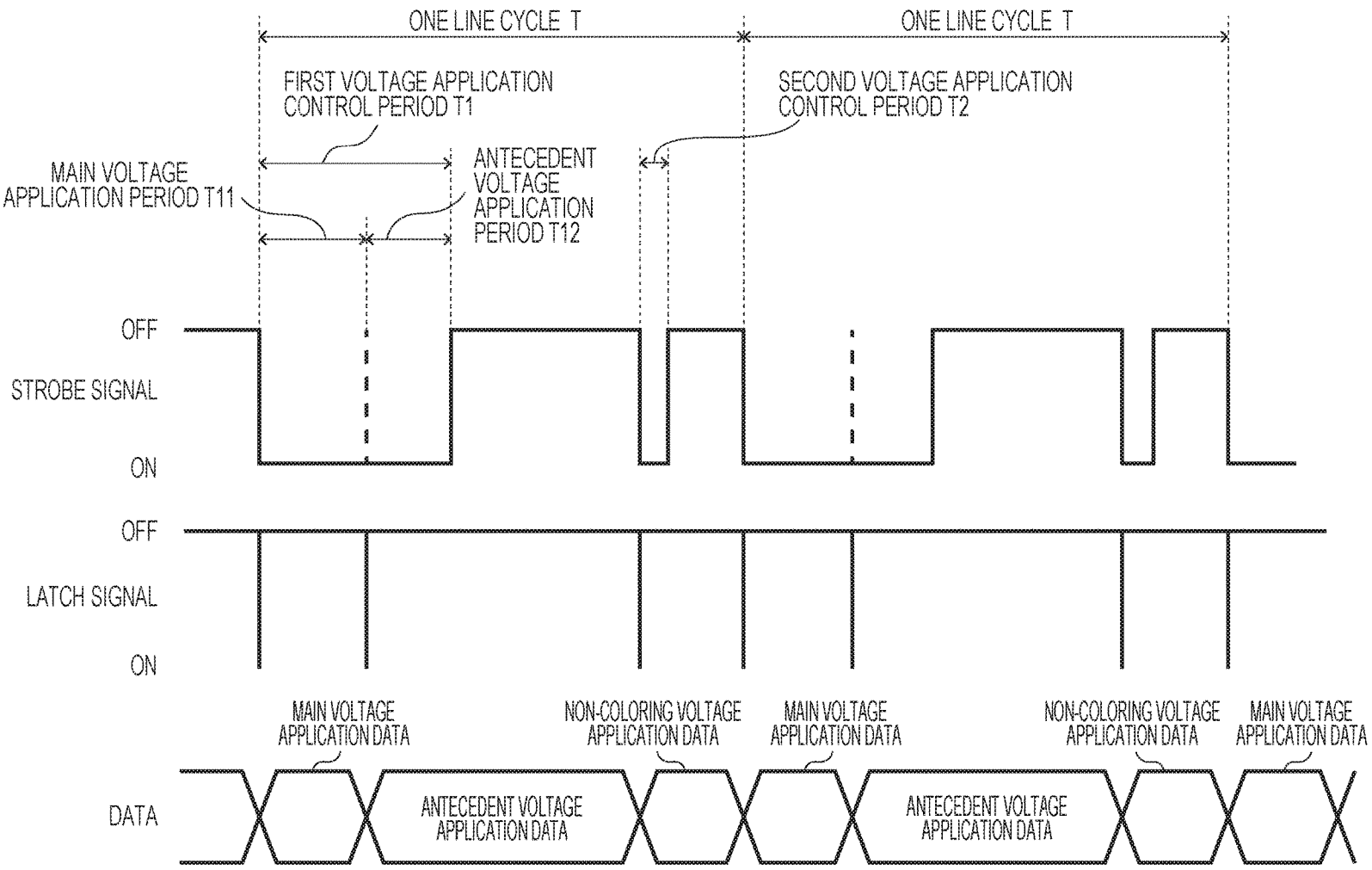
FIG. 6 illustrates an example of a timing chart of signals output from a control circuit.

FIG. 6 illustrates an example of a timing chart of signals output from the control circuit 5. FIG. 6 illustrates an example of a timing chart when batch printing to be described later is performed.

Figure 7:
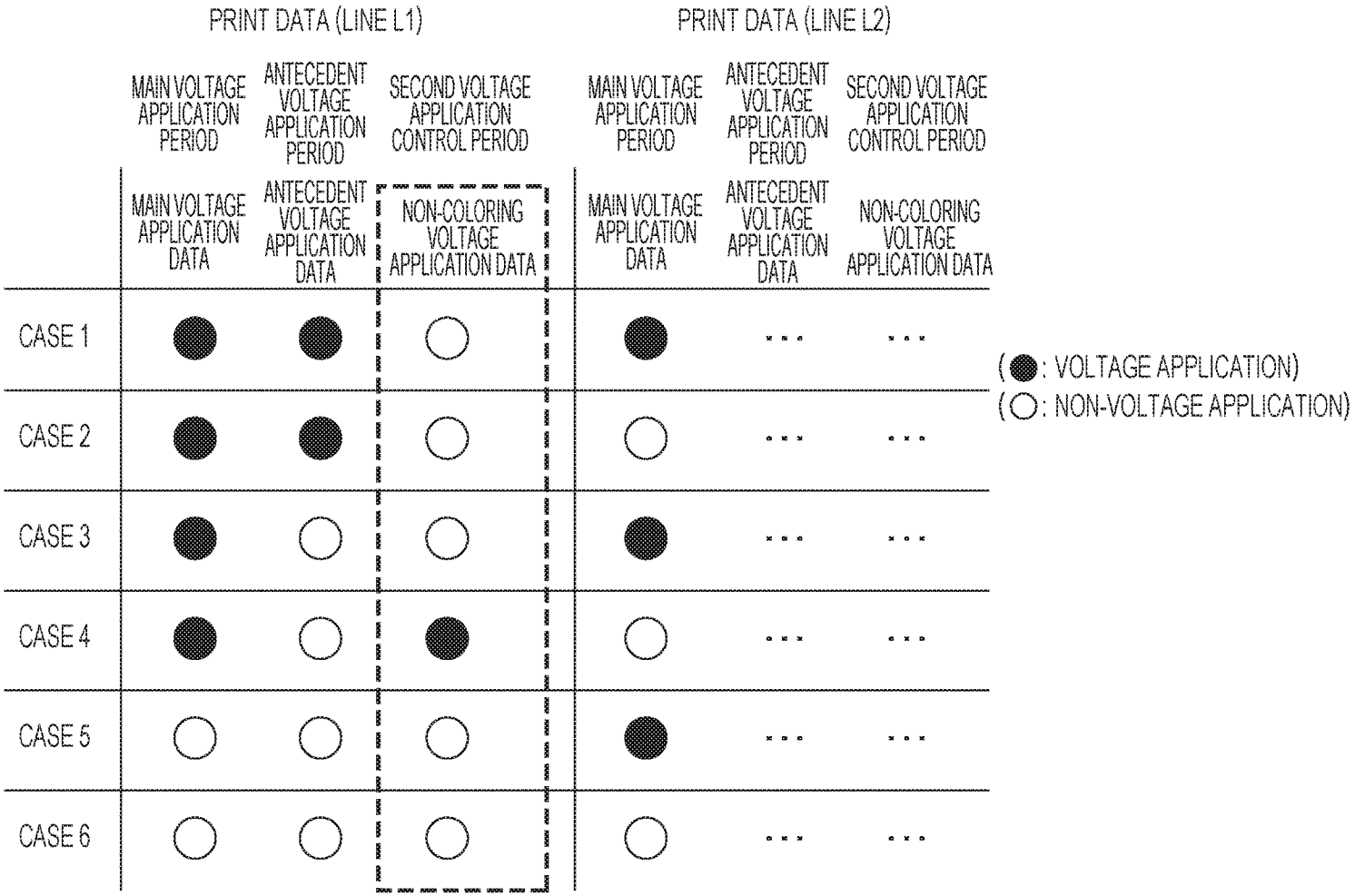
FIG. 7 is a diagram illustrating an example of print data generated by the control circuit.

FIG. 7 is a diagram illustrating an example of print data generated by the control circuit 5.

Hereinafter, the operation of the control circuit 5 will be described in detail with reference to FIGS. 6 and 7.

In the printing apparatus 1, as illustrated in FIG. 6, during the period (hereinafter, the time width in this period is referred to as one line cycle T) of the printing apparatus 1 performing printing and conveying for one line, the control circuit 5 supplies a strobe signal having a waveform including a first voltage application control period T1 and a second voltage application control period T2 to the head drive circuit 9.

The first voltage application control period T1 is a period for performing printing on the printing medium M on the basis of the print data, and the second voltage application control period T2 is a period for suppressing the occurrence of sticking by adjusting a temperature change of the thermal head 10 on the basis of the print data without performing printing on the printing medium M.

The control circuit 5 determines the waveform of the strobe signal so that printing on the printing medium M is not performed during the second voltage application control period T2.

More specifically, the control circuit 5 determines the waveform of the strobe signal so that the second voltage application control period T2 is set to a period of time which is so short that the printing medium M does not develop color even when application of a voltage to the heat generation element 10*a* is performed, which is not a zero time, and which is a period when the temperature of the heat generation element 10*a* is lowered to such an extent that the printing medium M does not develop color even when application of a voltage to the heat generation element 10*a* is performed during the second voltage application control period T2.

Therefore, it is preferable that the second voltage application control period T2 is set to a period which is separated from the first voltage application control period T1 in time and shorter than the first voltage application control period T1 and which is not a zero time.

Furthermore, it is preferable that the second voltage application control period T2 is set to a period which is shorter than the main voltage application period T11 to be described later and which is not a zero time.

As described above, in the printing apparatus 1, the control circuit 5 determines the waveform of the strobe signal and supplies the strobe signal to the head drive circuit 9, so that it is possible to suppress the occurrence of sticking by preventing a rapid drop in the temperature of the thermal head 10 without adversely affecting the printing quality.

In the printing apparatus 1, as illustrated in FIG. 6, the control circuit 5 replaces the print data retained by the head drive circuit 9 once during the first voltage application control period T1.

More specifically, the control circuit 5 replaces the print data retained by the head drive circuit 9 during the first voltage application control period T1 from the main voltage application data to an antecedent voltage application data.

Therefore, during the first voltage application control period T1 of the strobe signal, the head drive circuit 9 performs application of a voltage or non-application of a voltage to the heat generation element 10*a* on the basis of the main voltage application data and the antecedent voltage application data.

Herein, the main voltage application data is a first print data and is a print data representing a print pattern to be formed in a printing line (hereinafter, referred to as a target line) of the printing medium M to be printed during the first voltage application control period T1.

The antecedent voltage application data is a second print data which is generated on the basis of a print data in a preceding line (for example, a printing line preceding by one line before the target line) on which printing has been performed before the target line.

The main voltage application period T11 is a first period included in the first voltage application control period T1 and is a period in which the main voltage application data in the first voltage application control period T1 is retained in the head drive circuit 9 and application of a voltage or non-application of a voltage to the heat generation element 10*a* is performed on the basis of the main voltage application data.

The antecedent voltage application period T12 is a second period included in the first voltage application control period T1 and is a period in which the antecedent voltage application data in the first voltage application control period T1 is retained in the head drive circuit 9 and application of a voltage or non-application of a voltage to the heat generation element 10*a* is performed on the basis of the antecedent voltage application data.

The antecedent voltage application period T12 is a period later than the main voltage application period T11 in time.

In the printing apparatus 1, the control circuit 5 replaces the print data during the first voltage application control period T1, so that it is possible to realize gradation expression for printing a desired pattern with high quality.

In the printing apparatus 1, the control circuit 5 replaces the print data retained by the head drive circuit 9 once between the first voltage application control period T1 and the second voltage application control period T2.

More specifically, the control circuit 5 replaces the print data retained by the head drive circuit 9 between the first voltage application control period T1 and the second voltage application control period T2 from the antecedent voltage application data to the non-coloring voltage application data.

As a result, during the second voltage application control period T2 of the strobe signal, the head drive circuit 9 performs application of a voltage or non-application of a voltage to the heat generation element 10*a* on the basis of the non-coloring voltage application data.

Herein, the non-coloring voltage application data is the third print data and is print data for controlling the head drive circuit 9 so that application of a voltage to the heat generation element 10*a* is performed during the second voltage application control period T2 in the case where the main voltage application data and the antecedent voltage application data of two consecutive lines satisfy a specific condition.

In addition, the specific condition is a condition under which it is assumed that the temperature of the heat generation element 10*a* is remarkably lowered during one line cycle T in the case where there is no non-coloring voltage application data, and the non-coloring voltage application data is data for coping with sticking.

The non-coloring voltage application data is generated by the control circuit 5 on the basis of the main voltage application data and antecedent voltage application data of the target line and the main voltage application data of the next line (that is, print data representing a print pattern to be formed in the next line where printing is performed next to the target line).

This will be described in detail with reference to FIG. 7.

In FIG. 7, the main voltage application data, the antecedent voltage application data, and the non-coloring voltage application data are the same as those illustrated in FIG. 6.

In FIG. 7, black circles are ON indicating the voltage application state, and white circles are OFF indicating the non-voltage application state where application of a voltage is not performed.

As in Case 4 illustrated in FIG. 7, with respect to the heat generation element 10*a* of interest (hereinafter, referred to as the first heat generation element), when the main voltage application data (first print data) of a target line L1 is ON (black circle), the antecedent voltage application data (second print data) of the target line L1 is OFF (white circle), and the main voltage application data (fourth print data) of the next line L2 is OFF (white circle), the control circuit 5 generates the non-coloring voltage application data (third print data) of ON (black circle).

In other words, in the cases where the condition that application of a voltage to the first heat generation element is performed in only a period shorter than the first voltage application control period T1 during the first voltage application control period T1 immediately before the second voltage application control period T2 and the voltage application to the first heat generation element is not performed during the first voltage application control period T1 immediately after the second voltage application control period T2 is satisfied, the control circuit 5 generates the print data including the non-coloring voltage application data so that application of a voltage to the first heat generation element is performed during the second voltage application control period T2.

This is because, if the application of a voltage by the non-coloring voltage application data is not performed in Case 4, after the temperature of the heat generation element 10*a* becomes high due to the application of a voltage by the main voltage application data, application of a voltage is not performed for a long period of one line cycle T or more, and the temperature of the heat generation element 10*a* rapidly changes (decreases) from a high temperature to a low temperature.

In such circumstances, the ink ribbon melted when the heat generation element 10*a* reaches a high temperature is rapidly cooled due to a rapid decrease in the temperature of the heat generation element 10*a* and, thus, the ink ribbon is likely to stick to the thermal head 10. The state where the ink ribbon sticks to the thermal head 10 as described above is a state where sticking has occurred.

On the other hand, in the other cases (Cases 1 to 3, 5, and 6), the control circuit 5 generates the non-coloring voltage application data of OFF (white circle).

This is because, in Cases 1 to 3, the non-voltage application period occurring after the voltage application at the target line L1 is shorter than that in Case 4. As a result, since the sticking is unlikely to occur in Cases 1 to 3, the control circuit 5 generates the non-coloring voltage application data of OFF (white circle).

In Cases 5 and 6, there is no temperature increase at the target line L1. Therefore, no significant temperature decrease also occurs. As a result, since the sticking is unlikely to occur in Cases 5 and 6, the control circuit 5 generates the non-coloring voltage application data of OFF (white circle).

In the printing apparatus 1, the control circuit 5 generates the print data as described above, and thus, the application of a voltage to the heat generation elements 10*a* in accordance with the condition is performed during the second voltage application control period T2, so that it is possible to effectively suppress the occurrence of sticking.

In the printing apparatus 1, if it is attempted to perform batch printing of the printing lines by performing application of a voltage to the heat generation elements 10*a* of which the number exceeds a specific number among a plurality of the heat generation elements 10*a* included in the thermal head 10 at a time, in some cases, a current capacity of the power supply for supplying a voltage to the thermal head 10 becomes insufficient.

Therefore, in the case where the number of heat generation elements to which application of a voltage is to be performed exceeds a specific number, namely, in the case where printing of the printing lines having a plurality of print dots and of which the number exceeds a specific number is performed on the printing medium M, the control circuit 5 performs control so as to perform division printing in which printing of the printing line is divided into a plurality of times by time division.

More Specifically, a plurality of heat generation elements 10*a* corresponding to a plurality of print dots of the printing line scheduled to be printed are divided into a plurality of groups, and control is performed so as to perform application of a voltage to the heat generation elements 10*a* for each group in a time division manner. Accordingly, it possible to avoid a situation in which a current capacity of the power supply for supplying a voltage to the thermal head 10 becomes insufficient.

Figure 8:
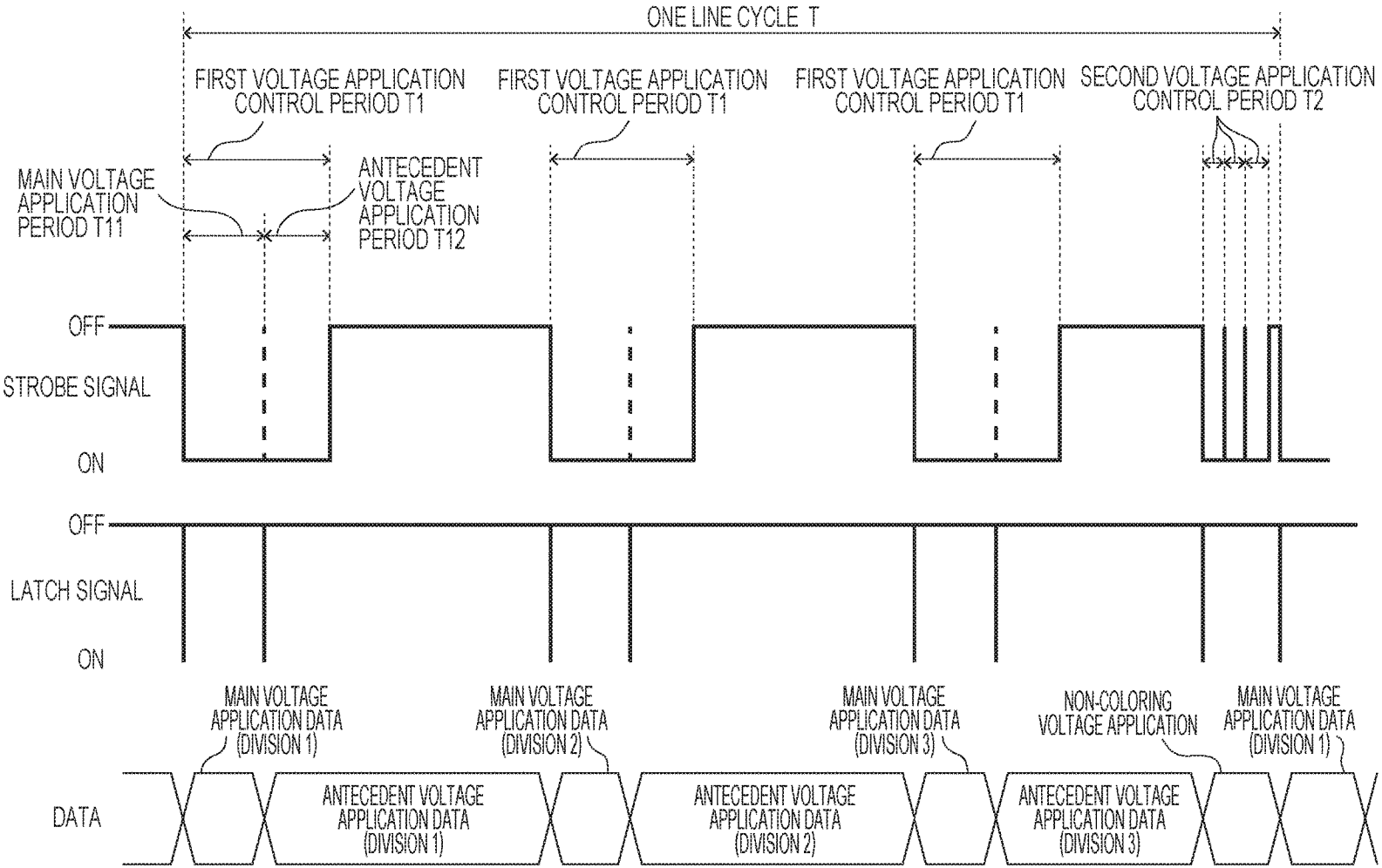
FIG. 8 illustrates another example of the timing chart of signals output from a control circuit.

FIG. 8 illustrates another example of the timing chart of signals output from the control circuit 5.

FIG. 6 illustrates the timing chart when batch printing is performed, whereas FIG. 8 illustrates the timing chart when division printing is performed.

FIG. 8 illustrates an example where the printing lines are divided into three times and division printing is performed.

Even in the case of performing the division printing, as illustrated in FIG. 8, the control circuit 5 supplies the strobe signal including the first voltage application control period T1 and the second voltage application control period T2 to the head drive circuit 9 during the period of one line cycle T.

This point is the same as the case of performing the batch printing.

However, the control circuit 5 in the case of performing the division printing is different from that in the case of performing the batch printing in that the plurality of first voltage application control periods T1 and the plurality of second voltage application control periods T2 corresponding to the plurality of first voltage application control periods T1 are included in one line cycle T.

The plurality of first voltage application control periods T1 are periods in which the application of a voltage to the different respective heat generation elements 10*a* is controlled, and the plurality of first voltage application control periods T1 are separated from each other within the period of one line cycle T.

The plurality of second voltage application control periods T2 are periods in which the application of a voltage to the same heat generation element 10*a* as the corresponding first voltage application control periods T1 is controlled.

The plurality of second voltage application control periods T2 are set to a time later than the plurality of first voltage application control periods T1 within a period of one line cycle T.

In this case, since the plurality of second voltage application control periods can be set at once, it is possible to suppress an increase in design difficulty caused by the setting of the second voltage application control periods.

It is particularly preferable that the plurality of second voltage application control periods T2 are set to be closer to the start timing of the period of the next one line cycle T than the end timing of the last first voltage application control period T1 within the period of one line cycle T.

Even in the case of performing the division printing, similarly to the case of performing the batch printing, the control circuit 5 may generate the print data. Namely, in the case where there is no second voltage application control period T2, if a specific condition that the temperature of the heat generation element 10*a* is assumed to significantly decrease during one line cycle T is satisfied, the print data may be generated so that application of a voltage to the heat generation element 10*a* is performed during the second voltage application control period T2.

In other words, the control circuit 5 may generate the print data, so that, with respect to the first voltage application control period T1 and the second voltage application control period T2 which are in a correspondence with each other, in the case where a condition that application of a voltage to the first heat generation element is performed in only a period shorter than the first voltage application control period T1 during the first voltage application control period T1 immediately before the second voltage application control period T2 and application of a voltage to the first heat generation element is not performed during the first voltage application control period T1 immediately after the second voltage application control period T2 is satisfied, application of a voltage to the first heat generation element is performed during the second voltage application control period T2.

This condition can also be paraphrased as follows.

Namely, the predetermined condition is that, when there are a first one-line cycle period and a second one-line cycle period as two consecutive one-line cycle periods, the application of a voltage to the first heat generation element (heat generation element 10*a*) is performed in only the main voltage application period (first period) in the first voltage application control period during the first voltage application control period which is the first voltage application control period immediately before the second voltage application control period and is included in the first one-line cycle period, and application of a voltage to the first heat generation element (heat generation element 10*a*) is not performed during the first voltage application control period which is the first voltage application control period immediately after the second voltage application control period and is included in the second one-line cycle period.

In the case of performing division printing, one line cycle T becomes longer than that in the case of performing batch printing. Therefore, the temperature of the thermal head 10 is likely to remarkably decrease as compared with the case of performing batch printing, and the sticking is likely to occur.

In consideration of this, the control circuit 5 may generate the print data so that application of a voltage to the first heat generation element is performed during the second voltage application control period T2 in the case where division printing is performed and the above conditions are satisfied.

Namely, when the following three conditions are satisfied for the first voltage application control period T1 and the second voltage application control period T2 that are in correspondence with each other, the control circuit 5 may generate the print data so that application of a voltage to the first heat generation element is performed during the second voltage application control period T2.

The first condition is that the second voltage application control period T2 is included in a period of one line cycle T for printing a target line having print dots of which the number exceeds a predetermined number.

The second condition is that application of a voltage to the first heat generation element is performed in only a period shorter than the first voltage application control period T1 during the first voltage application control period T1 immediately before the second voltage application control period T2.

The third condition is that application of a voltage to the first heat generation element is not performed during the first voltage application control period T1 immediately after the second voltage application control period T2.

If the number of divisions becomes 3 or more, sticking is particularly liable to occur. Therefore, the condition where the number of divisions is 3 or more may be regarded as the fourth condition for performing application of a voltage to the first heat generation element during the second voltage application control period T2.

The second condition and the third condition can also be paraphrased as follows.

Namely, the second condition is that, when there are a first one-line cycle period and a second one-line cycle period as two consecutive one-line cycle periods, the application of a voltage to the first heat generation element (heat generation element 10*a*) is performed in only the main voltage application period (first period) in the first voltage application control period during the first voltage application control period which is the first voltage application control period before the second voltage application control period and is included in the first one-line cycle period.

The third condition is that application of a voltage to the first heat generation element (heat generation element 10*a*) is not performed during the first voltage application control period which is the first voltage application control period after the second voltage application control period and is included in the second one-line cycle period.

Figure 9:
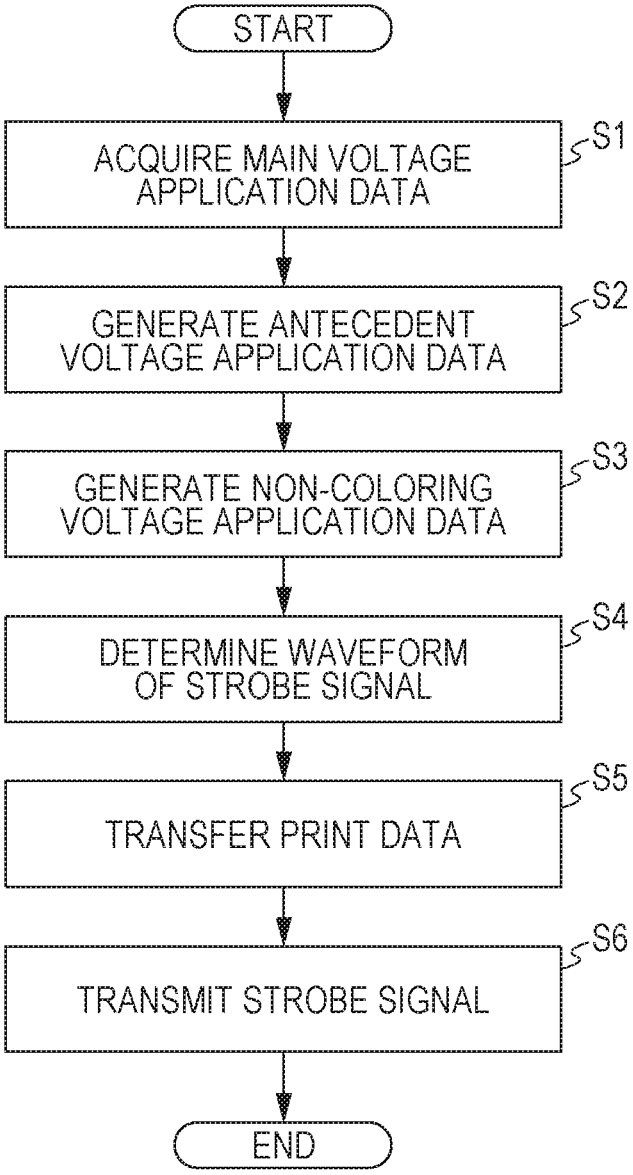
FIG. 9 is a flowchart illustrating a print control process.

FIG. 9 is a flowchart of the print control process.

Hereinafter, the print control process performed by the control circuit 5 will be described with reference to FIG. 9.

In the printing apparatus 1, if a start instruction of a printing process is input from the input device 3, the control circuit 5 executes the print program and performs a print control process illustrated in FIG. 8.

First, the control circuit 5 acquires main voltage application data (step S1).

The control circuit 5 may generate the main voltage application data on the basis of the input from the input device 3 or may receive the main voltage application data from the outside of the printing apparatus 1.

Next, the control circuit 5 generates antecedent voltage application data and non-coloring voltage application data (step S2 and step S3).

The control circuit 5 generates the antecedent voltage application data of the target line on the basis of the main voltage application data of the preceding line, for example, acquired in step S1.

Furthermore, the control circuit 5 generates the non-coloring voltage application data of the target line on the basis of, for example, the main voltage application data and antecedent voltage application data of the target line and the main voltage application data of the next line acquired in step S1.

As a result, the main voltage application data, the antecedent voltage application data, and the non-coloring voltage application data of the target line are prepared.

Thereafter, the control circuit 5 determines a waveform of the strobe signal (step S4).

Herein, the control circuit 5 determines the waveform of the strobe signal so that the strobe signal includes the first voltage application control period and the second voltage application control period.

In addition, the length of the first voltage application control period may be determined in consideration of the temperature of the thermal head 10 measured by the thermistor 13 or may be determined to be longer as the measured temperature becomes lower.

The length of the first voltage application control period may be further determined in consideration of a conveyance speed of the printing medium M, a tape width detected by the tape width detection switch 24, or the like.

Then, the control circuit 5 transfers the print data (the main voltage application data, the antecedent voltage application data, and the non-coloring voltage application data) acquired or generated in steps S1 to S3 to the head drive circuit 9 (step S5) and supplies the strobe signal of which the waveform is determined in step S4 to the head drive circuit 9 (step S6).

In response to the data and the signal, the head drive circuit 9 performs application of a voltage or non-application of a voltage to the heat generation element 10*a* on the basis of the print data during the voltage application control period of the strobe signal supplied from the control circuit 5.

By repeating the print control process illustrated in FIG. 9 for each line, the printing apparatus 1 can perform printing on the printing medium M while suppressing the occurrence of sticking.

While the above-described embodiments are described with reference to specific examples for easy understanding of the invention, the present invention is not limited to the above-described embodiments. Various modifications and changes can be made to the printing apparatus, the control method of the printing apparatus, and the program without departing from the scope of the claims.

In the above-described embodiments, the control circuit 5 is described as an example where the print data retained by the head drive circuit 9 is replaced once during the first voltage application control period T1. However, the print data may be replaced a plurality of times.

An example where printing is divided into three times when the number of print dots on a printing line exceeds a specific number is illustrated. However, the number of divisions may be two or more.

The printing apparatus 1 having the input device 3 and the display device 4 is exemplified. However, the printing apparatus may be a printing apparatus which does not have the input device 3 or the display device 4, and the print data may be received from a computer arranged separately.

Only a portion of the print data may be received from a computer, or all of the print data including the non-coloring voltage application data may be received from a computer.

What is claimed is:

1. A printing apparatus comprising:

a thermal head that performs printing on a printing medium;

a head drive circuit that drives the thermal head; and a processor configured to generate a control signal and print data and to supply the control signal and the print data to the head drive circuit, wherein:

the thermal head has a plurality of heat generation elements whose temperatures are controlled by applying a voltage, the head drive circuit controls application of a voltage to each of the plurality of heat generation elements according to drive data periodically supplied, the drive data including the control signal and the print data, one period of the control signal includes a first voltage application control period and a second voltage application control period which are separated from each other, the first voltage application control period is a period in which the printing is performed by controlling the application of a voltage, the second voltage application control period is a period in which the printing is not performed and a temperature of the thermal head is adjusted by controlling the application of a voltage, the head drive circuit drives the thermal head so that the printing is sequentially performed line by line on the printing medium by the thermal head based on the print data, the first voltage application control period and the second voltage application control period are set within a period of one line cycle for the thermal head to print the one line on the printing medium, the second voltage application control period is set to be a time which is shorter than the first voltage application control period, which is not zero time, and in which the printing is not performed the processor generates the print data so that, in a period of the one line cycle corresponding to a first line scheduled to be printed by the thermal head and a period of the one line cycle corresponding to a second line scheduled to be printed immediately after the first line, in the case where a state of the application of a voltage to at least one specific heat generation element among the plurality of heat generation elements in the first voltage application control period satisfies a specific condition, the application of a voltage to the specific heat generation element is performed during the second voltage application control period in the period of the one line cycle corresponding to the first line, the first voltage application control period includes a first period and a second period after the first period, and the specific condition is that the application of a voltage to the specific heat generation element is performed in the first period during the first voltage application control period in the period of the one line cycle corresponding to the first line, the application of a voltage to the specific heat generation element is not performed in the second period, and the application of a voltage to the specific heat generation element is not performed during the first voltage application control period in the period of the one line cycle corresponding to the second line.

2. The printing apparatus according to claim 1, wherein the second voltage application control period is a period for suppressing a decrease in the temperature of the thermal head.

3. The printing apparatus according to claim 1, wherein:

the one line printed on the printing medium has more than a predetermined number of print dots, and the processor generates the control signal so that, when the thermal head performs the printing of the one line on the printing medium, the waveform of the control signal includes a plurality of the first voltage application control periods which are separated from each other and in which the application of a voltage to the heat generation elements different from each other is controlled, and a plurality of the second voltage application control periods corresponding to the plurality of first voltage application control periods within the period of the one line cycle.

4. The printing apparatus according to claim 3, wherein the plurality of second voltage application control periods are set to a time later than the plurality of first voltage application control periods within the period of the one line cycle.

5. A printing apparatus comprising:

a thermal head that performs printing on a printing medium; and a head drive circuit that drives the thermal head, wherein:

the thermal head has a plurality of heat generation elements whose temperatures are controlled by applying a voltage, the head drive circuit controls application of a voltage to each of the plurality of heat generation elements according to drive data periodically supplied, the drive data including a control signal and print data, one period of the control signal includes a first voltage application control period and a second voltage application control period which are separated from each other, the first voltage application control period is a period in which the printing is performed by controlling the application of a voltage, the second voltage application control period is a period in which the printing is not performed and a temperature of the thermal head is adjusted by controlling the application of a voltage, the head drive circuit drives the thermal head so that the printing is sequentially performed line by line on the printing medium by the thermal head based on the print data, the print data includes:

first print data representing a print pattern to be formed on a target line to be printed on the printing medium;

second print data generated based on a print pattern to be formed on a preceding line on which the printing is performed before the target line by the thermal head; and third print data generated based on the first print data, the second print data, and fourth print data representing a print pattern to be formed on a next line on which the printing is performed after the target line, and the head drive circuit:

performs application or non-application of a voltage to each of the plurality of heat generation elements based on the first print data and the second print data during the first voltage application control period, and performs application or non-application of a voltage to each of the plurality of heat generation elements based on the third print data during the second voltage application control period.

6. A control method of a printing apparatus, the printing apparatus including a thermal head that performs printing on a printing medium and a head drive circuit that drives the thermal head, the thermal head having a plurality of heat generation elements whose temperatures are controlled by applying a voltage, and the head drive circuit controlling application of a voltage to each of the plurality of heat generation elements according to drive data periodically supplied, the drive data including a control signal and print data, and the control method comprising:

setting one period of the control signal so as to include a first voltage application control period and a second voltage application control period which are separated from each other, the first voltage application control period being a period in which the printing is performed by controlling the application of a voltage, and the second voltage application control period being a period in which the printing is not performed and a temperature of the thermal head is adjusted by controlling the application of a voltage; and supplying the control signal and the print data to the head drive circuit to drive the thermal head by the head drive circuit so that the printing is sequentially performed line by line on the printing medium by the thermal head based on the print data, wherein:

the first voltage application control period and the second voltage application control period are set within a period of one line cycle for the thermal head to print the one line on the printing medium, the second voltage application control period is set to be a time which is shorter than the first voltage application control period, which is not zero time, and in which the printing is not performed, the print data is generated so that, in a period of the one line cycle corresponding to a first line scheduled to be printed by the thermal head and a period of the one line cycle corresponding to a second line scheduled to be printed immediately after the first line, in the case where a state of the application of a voltage to at least one specific heat generation element among the plurality of heat generation elements in the first voltage application control period satisfies a specific condition, the application of a voltage to the specific heat generation element is performed during the second voltage application control period in the period of the one line cycle corresponding to the first line, the first voltage application control period includes a first period and a second period after the first period, and the specific condition is that the application of a voltage to the specific heat generation element is performed in the first period during the first voltage application control period in the period of the one line cycle corresponding to the first line, the application of a voltage to the specific heat generation element is not performed in the second period, and the application of a voltage to the specific heat generation element is not performed during the first voltage application control period in the period of the one line cycle corresponding to the second line.

7. The control method according to claim 6, wherein the second voltage application control period is a period for suppressing a decrease in the temperature of the thermal head.

8. The control method according to claim 6, wherein:

the one line printed on the printing medium has more than a predetermined number of print dots, and the control signal is generated so that, when the thermal head performs the printing of the one line on the printing medium, the waveform of the control signal includes a plurality of the first voltage application control periods which are separated from each other and in which the application of a voltage to the heat generation elements different from each other is controlled, and a plurality of the second voltage application control periods corresponding to the plurality of first voltage application control periods within the period of the one line cycle.

9. The control method according to claim 8, wherein the plurality of second voltage application control periods are set to a time later than the plurality of first voltage application control periods within the period of the one line cycle.

10. A control method of a printing apparatus, the printing apparatus including a thermal head that performs printing on a printing medium and a head drive circuit that drives the thermal head, the thermal head having a plurality of heat generation elements whose temperatures are controlled by applying a voltage, and the head drive circuit controlling application of a voltage to each of the plurality of heat generation elements according to drive data periodically supplied, the drive data including a control signal and print data, and the control method comprising:

setting one period of the control signal so as to include a first voltage application control period and a second voltage application control period which are separated from each other, the first voltage application control period being a period in which the printing is performed by controlling the application of a voltage and the second voltage application control period being a period in which the printing is not performed and a temperature of the thermal head is adjusted by controlling the application of a voltage; and supplying the control signal and the print data to the head drive circuit to drive the thermal head by the head drive circuit so that the printing is sequentially performed line by line on the printing medium by the thermal head based on the print data, wherein the print data includes:

first print data representing a print pattern to be formed on a target line to be printed on the printing medium;

second print data generated based on a print pattern to be formed on a preceding line on which the printing is performed before the target line by the thermal head; and third print data generated based on the first print data, the second print data, and fourth print data representing a print pattern to be formed on a next line on which the printing is performed after the target line, and wherein the control method further comprises:

allowing the head drive circuit to perform application or non-application of a voltage to each of the plurality of heat generation elements based on the first print data and the second print data during the first voltage application control period; and allowing the head drive circuit to perform application or non-application of a voltage to each of the plurality of heat generation elements based on the third print data during the second voltage application control period.

11. A non-transitory computer-readable recording medium on which a control program of a printing apparatus is recorded, the printing apparatus including a thermal head that performs printing on a printing medium and a head drive circuit that drives the thermal head, the thermal head having a plurality of heat generation elements whose temperatures are controlled by applying a voltage, the head drive circuit controlling application of a voltage to each of the plurality of heat generation elements according to drive data periodically supplied, the drive data including a control signal and print data, and the control program controlling a computer of the printing apparatus to:

set one period of the control signal so as to include a first voltage application control period and a second voltage application control period which are separated from each other, the first voltage application control period being a period in which the printing is performed by controlling the application of a voltage, and the second voltage application control period being a period in which the printing is not performed and a temperature of the thermal head is adjusted by controlling the application of a voltage; and supply the control signal and the print data to the head drive circuit to drive the thermal head by the head drive circuit so that the printing is sequentially performed line by line on the printing medium by the thermal head based on the print data, wherein:

the first voltage application control period and the second voltage application control period are set within a period of one line cycle for the thermal head to print the one line on the printing medium, the second voltage application control period is set to be a time which is shorter than the first voltage application control period, which is not zero time, and in which the printing is not performed, the print data is generated so that, in a period of the one line cycle corresponding to a first line scheduled to be printed by the thermal head and a period of the one line cycle corresponding to a second line scheduled to be printed immediately after the first line, in the case where a state of the application of a voltage to at least one specific heat generation element among the plurality of heat generation elements in the first voltage application control period satisfies a specific condition, the application of a voltage to the specific heat generation element is performed during the second voltage application control period in the period of the one line cycle corresponding to the first line, the first voltage application control period includes a first period and a second period after the first period, and the specific condition is that the application of a voltage to the specific heat generation element is performed in the first period during the first voltage application control period in the period of the one line cycle corresponding to the first line, the application of a voltage to the specific heat generation element is not performed in the second period, and the application of a voltage to the specific heat generation element is not performed during the first voltage application control period in the period of the one line cycle corresponding to the second line.

* * * * *